US008007222B1

(12) United States Patent
Roden

(10) Patent No.: US 8,007,222 B1
(45) Date of Patent: Aug. 30, 2011

(54) VARIABLE COUNTERWEIGHT SYSTEM FOR A MATERIAL HANDLING DEVICE

(75) Inventor: Thomas V. Roden, Port Washington, WI (US)

(73) Assignee: ET&T Engineering LLP, Saukville, WI (US)

( * ) Notice: Subject to any disclaimer, the term of this patent is extended or adjusted under 35 U.S.C. 154(b) by 515 days.

(21) Appl. No.: 11/756,069

(22) Filed: May 31, 2007

(51) Int. Cl.
*B66C 23/00* (2006.01)

(52) U.S. Cl. ..... 414/719; 212/198

(58) Field of Classification Search ..... 414/719, 414/673; 280/758; 212/196, 197, 198
See application file for complete search history.

(56) References Cited

U.S. PATENT DOCUMENTS 2,926,799 A 3/1960 Granryd ..... 214/142
3,497,095 A * 2/1970 Couberly ..... 414/629
5,160,056 A * 11/1992 Yoshimatsu et al. ..... 212/277
5,219,180 A * 6/1993 Zipser et al. ..... 280/759
5,685,563 A * 11/1997 Ottestad ..... 280/758
7,128,517 B1 10/2006 Kurtz ..... 414/686

* cited by examiner

*Primary Examiner* — Donald Underwood
(74) *Attorney, Agent, or Firm* — Jeffrey W. Sainlo

(57) ABSTRACT

A variable counterweight system includes a counterweight and at least one linear transfer device. The counterweight preferably includes a plurality of individual counterweight members. Each linear transfer device preferably includes a moving track and a drive device. The moving track could be a chain or a belt. The drive device is preferably a hydraulic, electric or pneumatic motor. The moving track is preferably retained in a guide track. A control unit receives input from at least one vertical sensor. If an attachment or a boom is in an elevated position, then the control unit powers the at least one drive device to move the counterweight to a rear of the skid steer. If the attachment or boom is in a lowered position, then the control unit powers the at least one drive device to move the counterweight to a front of the skid steer.

1 Claim, 8 Drawing Sheets

VARIABLE COUNTERWEIGHT SYSTEM FOR A MATERIAL HANDLING DEVICE

BACKGROUND OF THE INVENTION

1. Field of the Invention

The present invention relates generally to earth moving devices and more specifically to a variable counterweight system for an earth moving device, which increases the operational safety of the earth moving device.

2. Discussion of the Prior Art

U.S. Pat. No. 2,926,799 to Granryd discloses a counterweight arrangement for a tractor loader. The Grandryd patent includes a counterweight that is pivoted on the rear of a tractor loader according to a position of a conventional bucket. U.S. Pat. No. 7,128,517 to Kurtz discloses a loader with extending bucket and counter balance. The Kurtz patent includes a small loader machine of the skid-steered type having a counterweight to balance heavy loads in the loader bucket. The bucket is automatically extended forward as the counterweight is extended in the opposite direction so as to keep the machine always in reasonable balance.

Accordingly, there is a clearly felt need in the art for a variable counterweight system for a earth moving device, which includes a counterweight that is moved from a front of the earth moving device to a rear of the earth moving device depending on a vertical position of an attachment, such as a bucket.

SUMMARY OF THE INVENTION

The present invention provides a variable counterweight system for an earth moving device, which includes a counterweight that is movable between a front and rear of the earth moving device. The variable counterweight system for an earth moving device (variable counterweight system) includes a counterweight and at least one linear transfer device. The counterweight preferably includes a plurality of individual counterweight members. Horizontally adjacent counterweight members are preferably pivotally engaged with each other. Vertically adjacent counterweight members are preferably attached to each other. Each linear transfer device preferably includes a moving track and a drive device. The moving track could be a chain or a belt. The drive device is preferably a hydraulic, electric or pneumatic motor. The moving track is retained on two rotary axles. The rotary axles are preferably retained by a guide track. The moving track is preferably retained in the guide track. The drive device includes either a sprocket or a cog for driving the chain or belt, respectively. A sprocket or cog is mounted to each rotary axle.

At least one vertical sensor determines the position of an attachment or a boom. At least one horizontal sensor determines the position of the counterweight relative to the front and rear of the skid steer. A control unit receives input from the at least one vertical sensor. If the attachment or boom is in an elevated position, the control unit powers the at least one drive device to move the counterweight to a rear of the skid steer. The at least one motor is powered, until the counterweight reaches the rear of the skid steer. The at least one horizontal sensor detects, when the counterweight is located at the rear of the skid steer. The control unit stops supplying power to the at least one drive device, when the counterweight is at the rear of the skid steer. However, the horizontal positioning of the counterweight could also be manually manipulated by an operator.

If the attachment or boom is in a lowered position, then the control unit powers the at least one drive device to move the counterweight to a front of the earth moving device. The at least one drive device is powered, until the counterweight reaches the front of the skid steer. The at least one horizontal sensor detects, when the counterweight is located at the front of the skid steer. The control unit stops supplying power to the at least one drive device, when the counterweight is at the front of the earth moving device. A skid steer is one of many types of earth moving devices.

Accordingly, it is an object of the present invention to provide a variable counterweight system, which includes a a counterweight that is moved from a front of the earth moving device to a rear of the earth moving device depending on a vertical position of an attachment.

These and additional objects, advantages, features and benefits of the present invention will become apparent from the following specification.

DETAILED DESCRIPTION OF THE PREFERRED EMBODIMENTS

Figure 1:
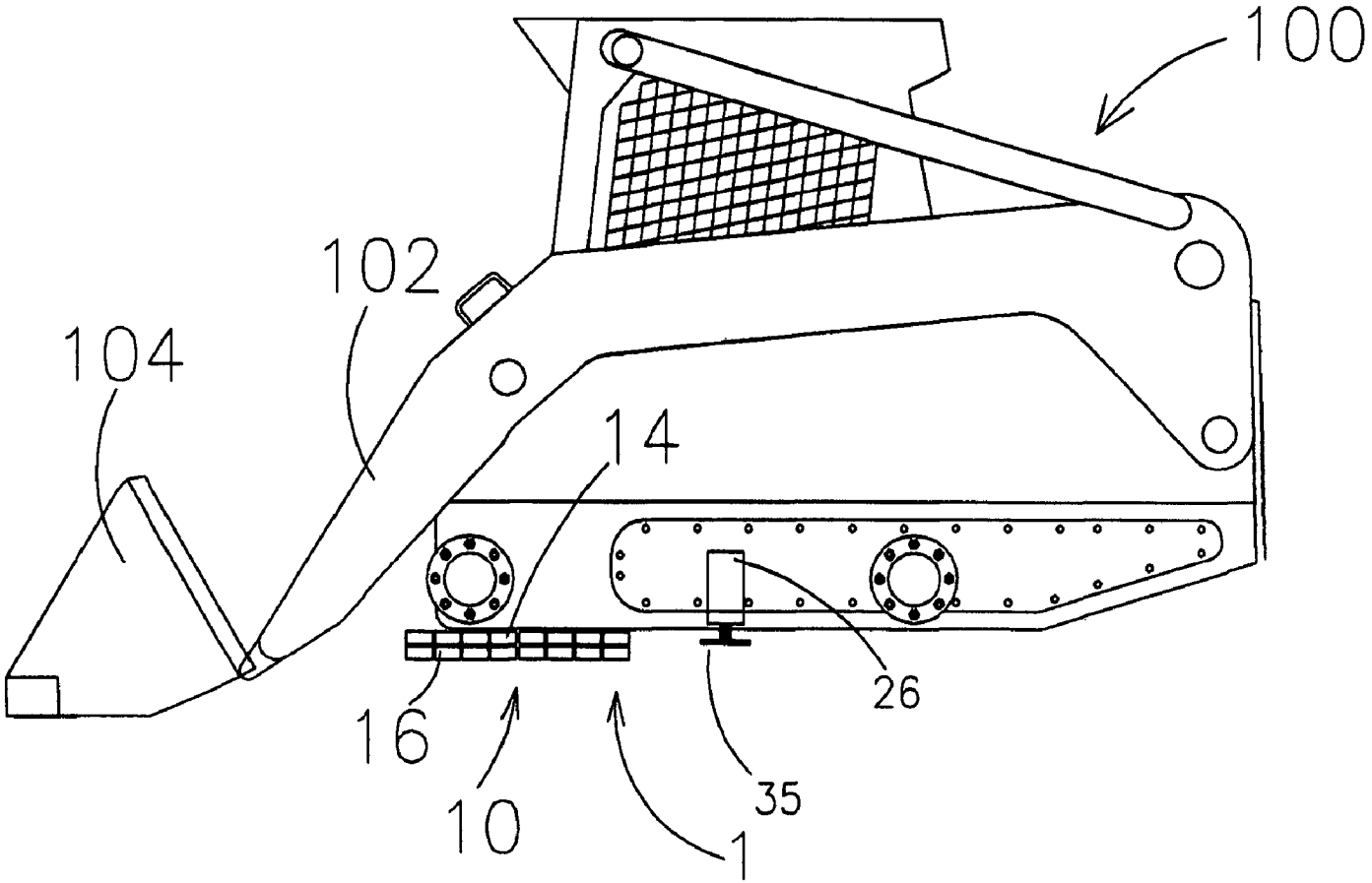
FIG. 1 is a side view of a skid steer with a variable counterweight system, where a counterweight is positioned at a front of the skid steer in accordance with the present invention.
Figure 2:
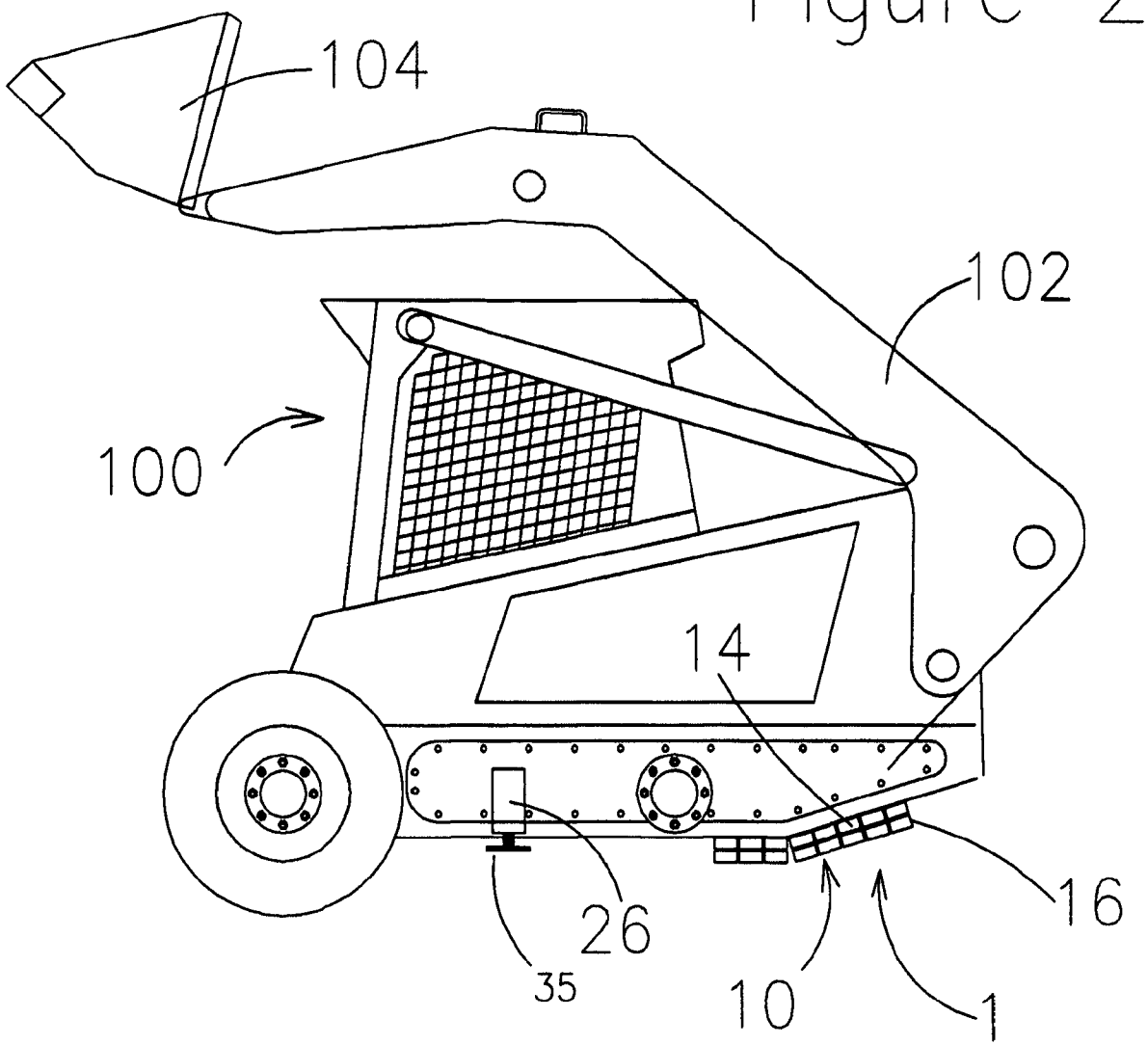
FIG. 2 is a side view of a skid steer with a variable counterweight system, where a counterweight is positioned at a rear of the skid steer in accordance with the present invention.
Figures 3A, 3B:
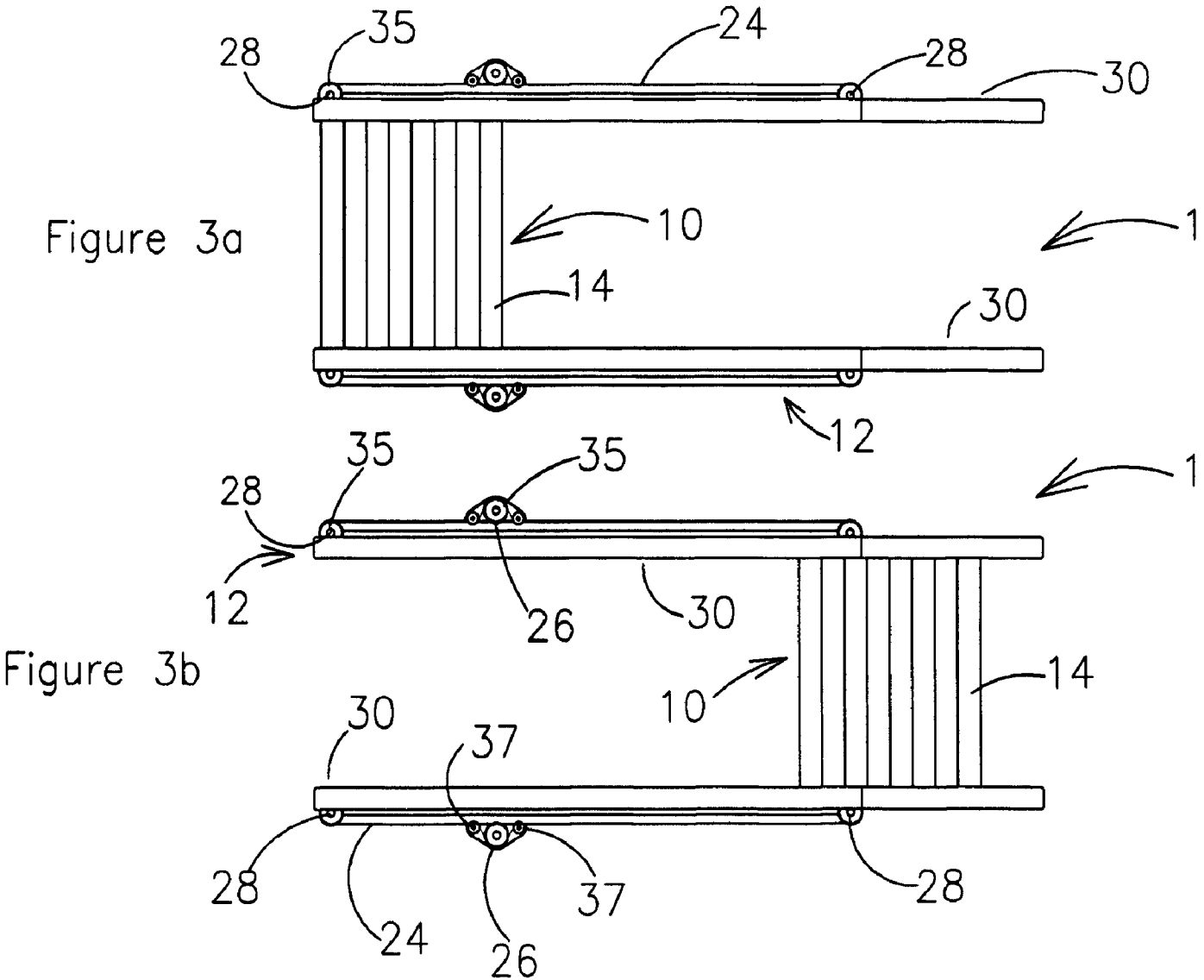
FIG. 3*a* is a top view of a variable counterweight system with a counterweight positioned at a front thereof in accordance with the present invention.
FIG. 3*b* is a top view of a variable counterweight system with a counterweight positioned at a rear thereof in accordance with the present invention.
Figure 4:
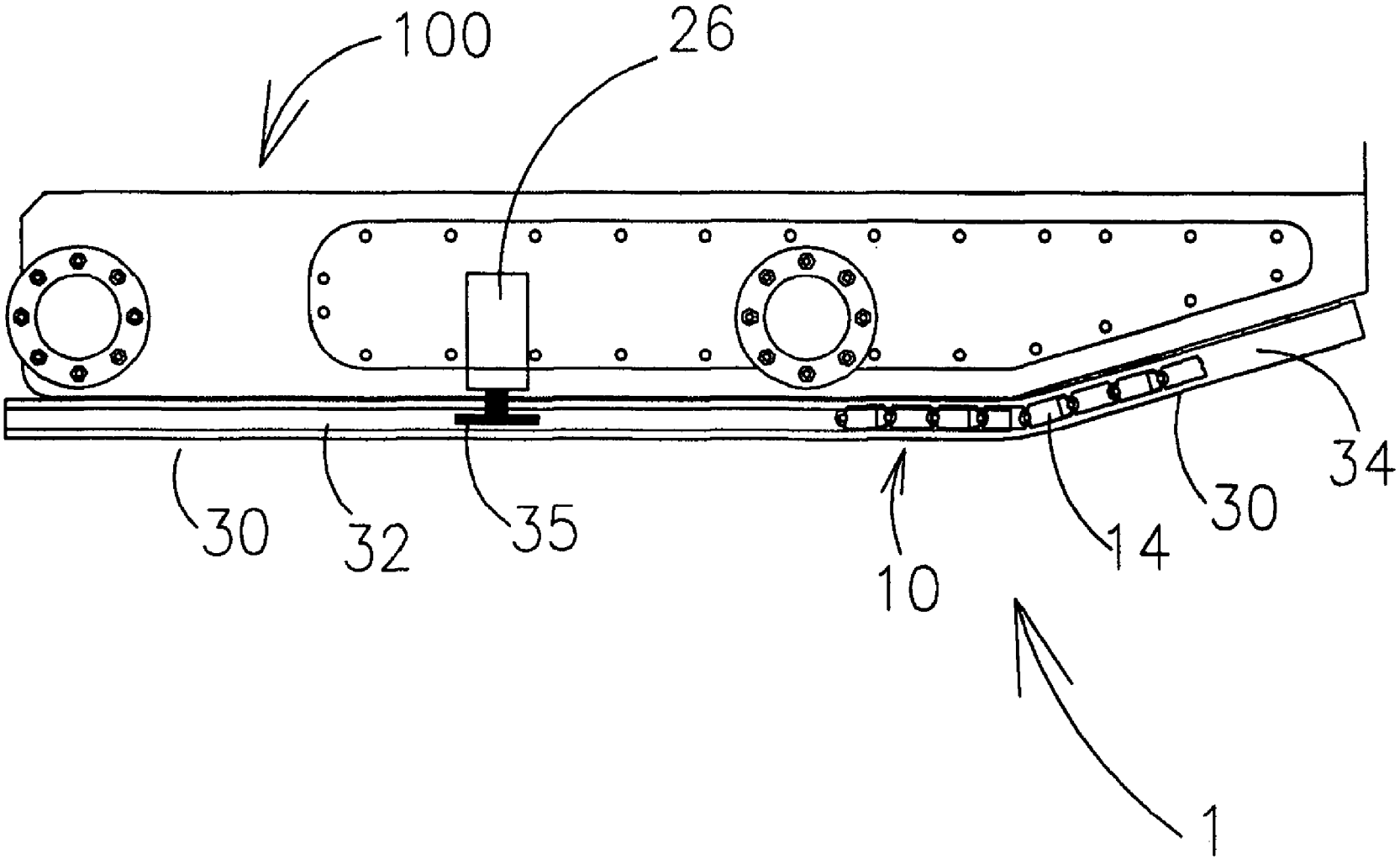
FIG. 4 is an enlarged side view of a skid steer with a variable counterweight system, where a counterweight is positioned at a rear of the skid steer in a guide track in accordance with the present invention.
Figure 5:
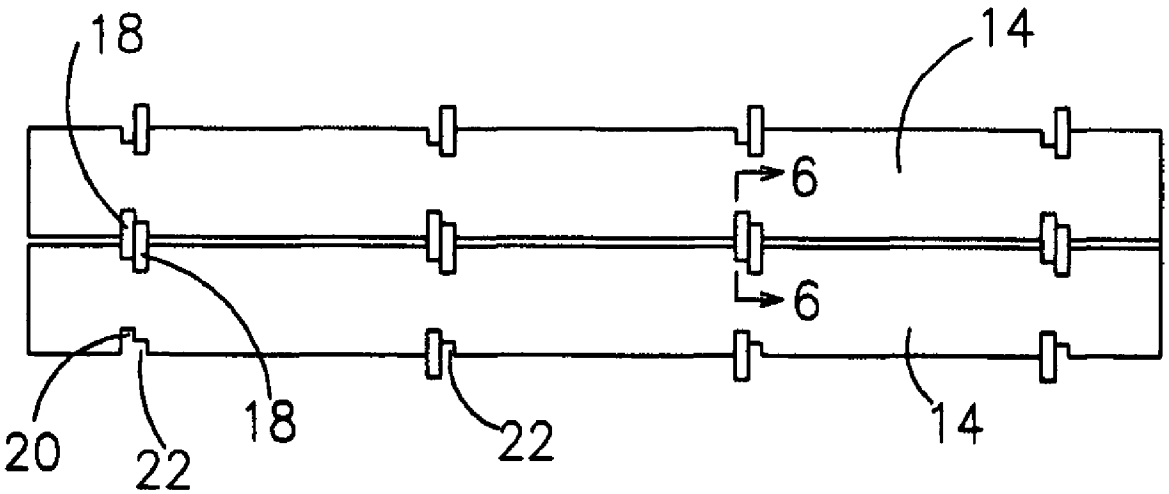
FIG. 5 is an enlarged top view of two weight members pivotally engaged with each other of a variable counterweight system in accordance with the present invention.
Figure 6:
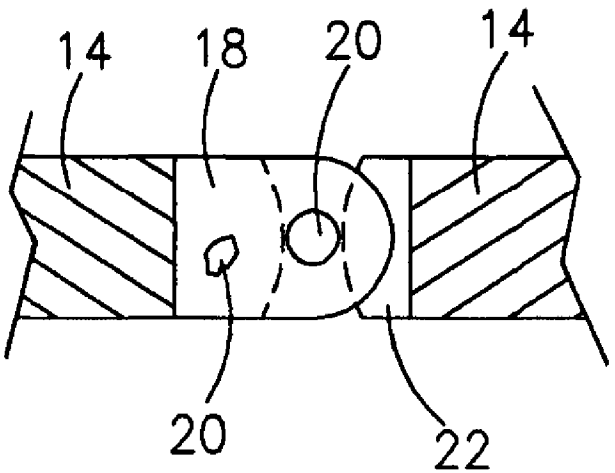
FIG. 6 is an enlarged cross sectional view of two weight members pivotally engaged with each other of a variable counterweight system in accordance with the present invention.
Figure 7:
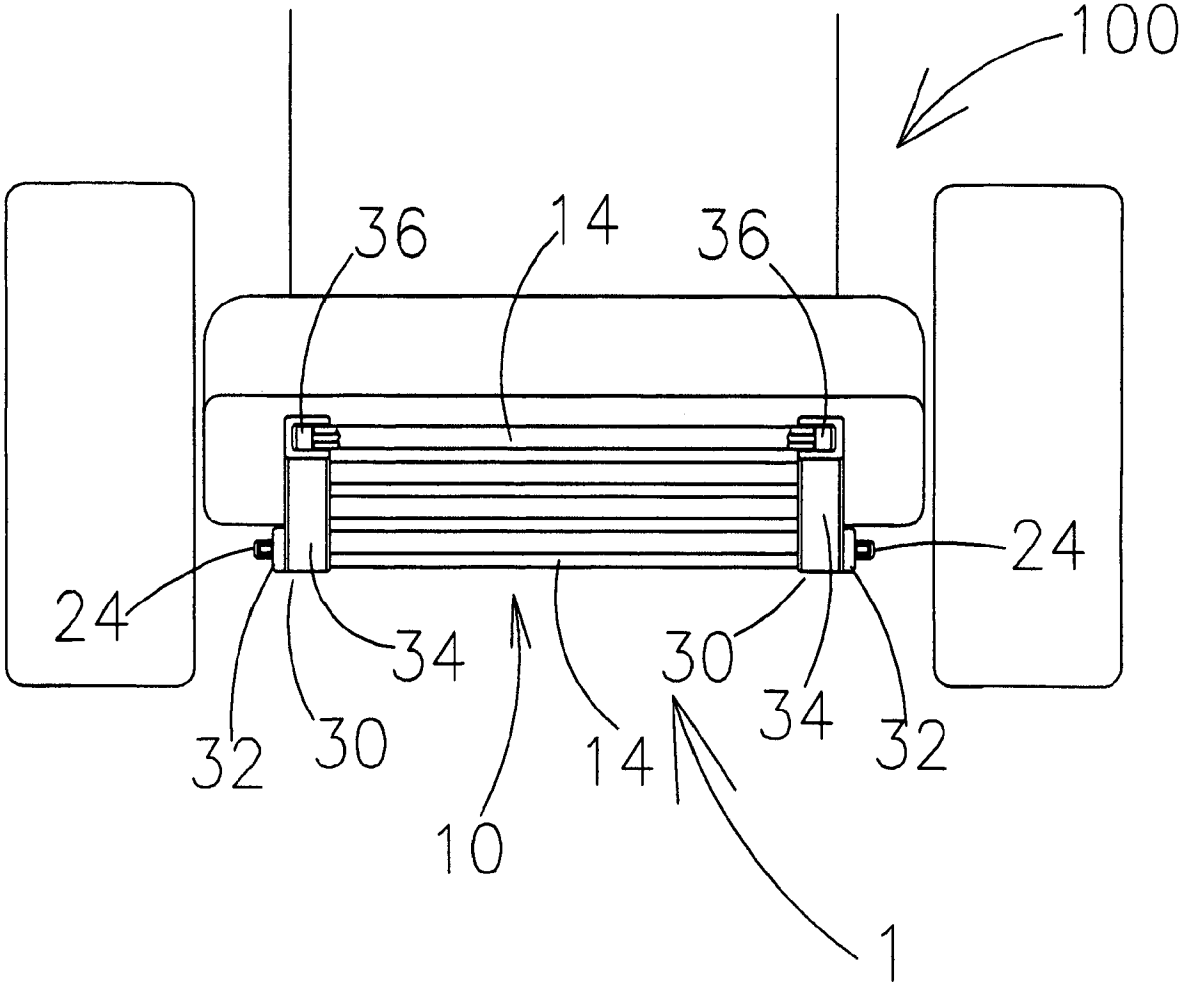
FIG. 7 is a rear view of a skid steer with a variable counterweight system in accordance with the present invention.
Figure 8:
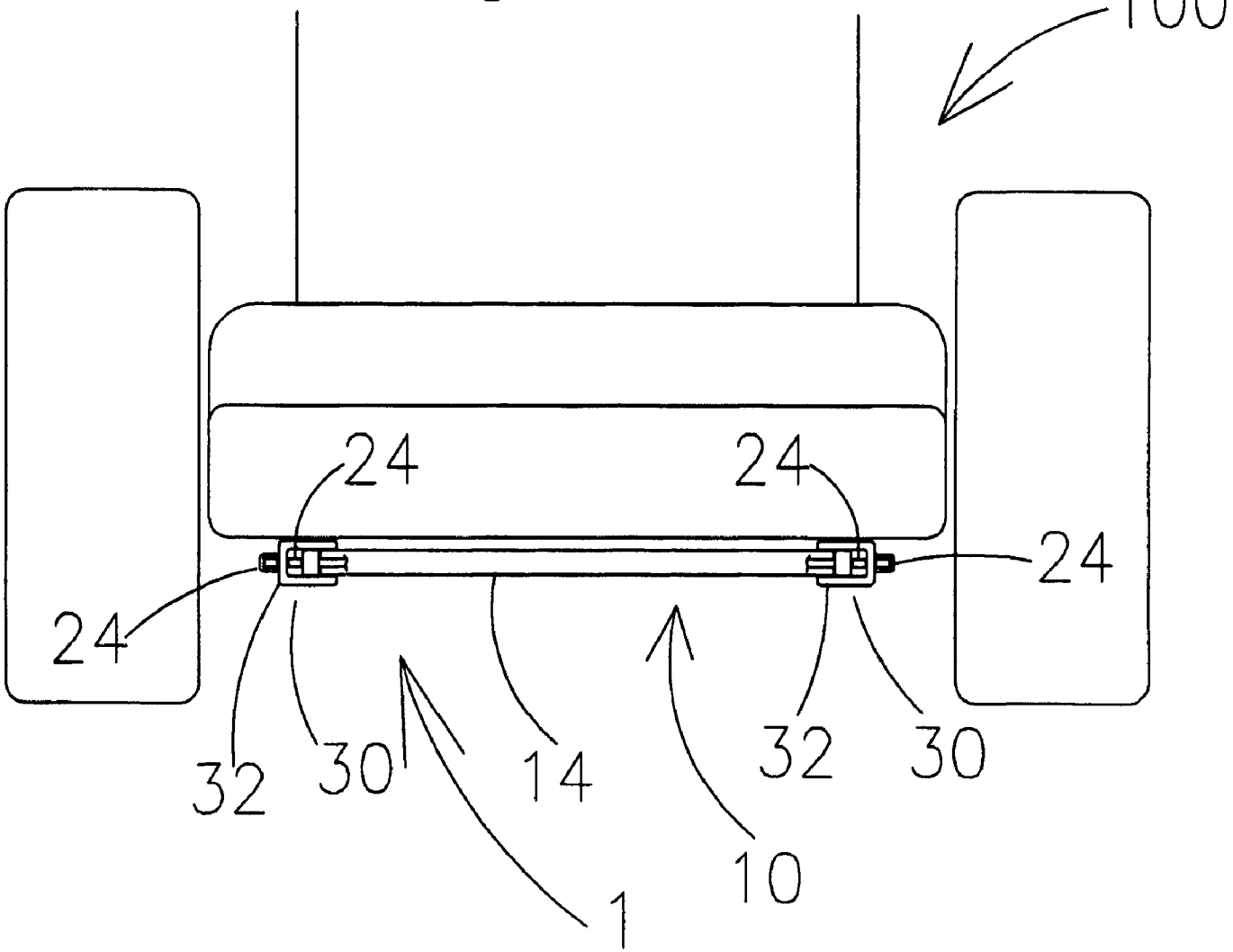
FIG. 8 is a cross sectional of a variable counterweight system mounted to a skid steer in accordance with the present invention.

With reference now to the drawings, and particularly to FIG. 1, there is shown a side view of a skid steer 100 with a portion of a variable counterweight system 1. With reference to FIGS. 2-6, the variable counterweight system 1 includes a counterweight 10 and at least one linear transfer device 12. The counterweight 10 preferably includes a plurality of pivoting weight members 14 and a plurality of hanging weight members 16. A top of each hanging weight member 16 is attached to a bottom of an adjacent pivoting weight member 14 with at least two fasteners or the like. A plurality of link slots 20 and a plurality of link clearance slots 22 are cut into each end of each adjacent pivoting weight member 14. A plurality of pivoting links 18 are secured to each pivoting weight member 14 by welding or any other suitable process. Each linear transfer device 12 preferably includes a moving track 24 and a drive device 26. However, other types of linear transfer devices may be used, such as a pair of hydraulic cylinders. The moving track 24 could be a chain or a belt. The drive device 26 is preferably a hydraulic, electric or pneumatic motor. The moving track 24 is retained on two rotary axles 28. With reference to FIGS. 7-8, the rotary axles 28 are preferably retained by a guide track 30. The moving track 24 is preferably retained in the guide track 30. The guide track 30 is mounted to a bottom of the skid steer 100. The drive device 26 includes either a sprocket or a cog 35 for driving the chain or belt, respectively. A sprocket or cog 35 is mounted to each rotary axle 28 to retain the chain or belt, respectively. A pair of idler shafts 37 may be located adjacent the sprocket or cog 35 to guide the moving track 24. The guide track 30 includes a moving track portion 32 and a counterweight portion 34. The moving track portion 32 supports a portion of the moving track 24. The counterweight portion 34 supports the counterweight 10. A rolling bearing 36 may be pivotally retained on each end of at least some of the pivoting weight member 14. The rolling bearing 36 includes a diameter that is greater than a thickness of each pivoting weight bearing 14. The rolling bearing 36 rolls within the counterweight portion 34.

Figure 9:
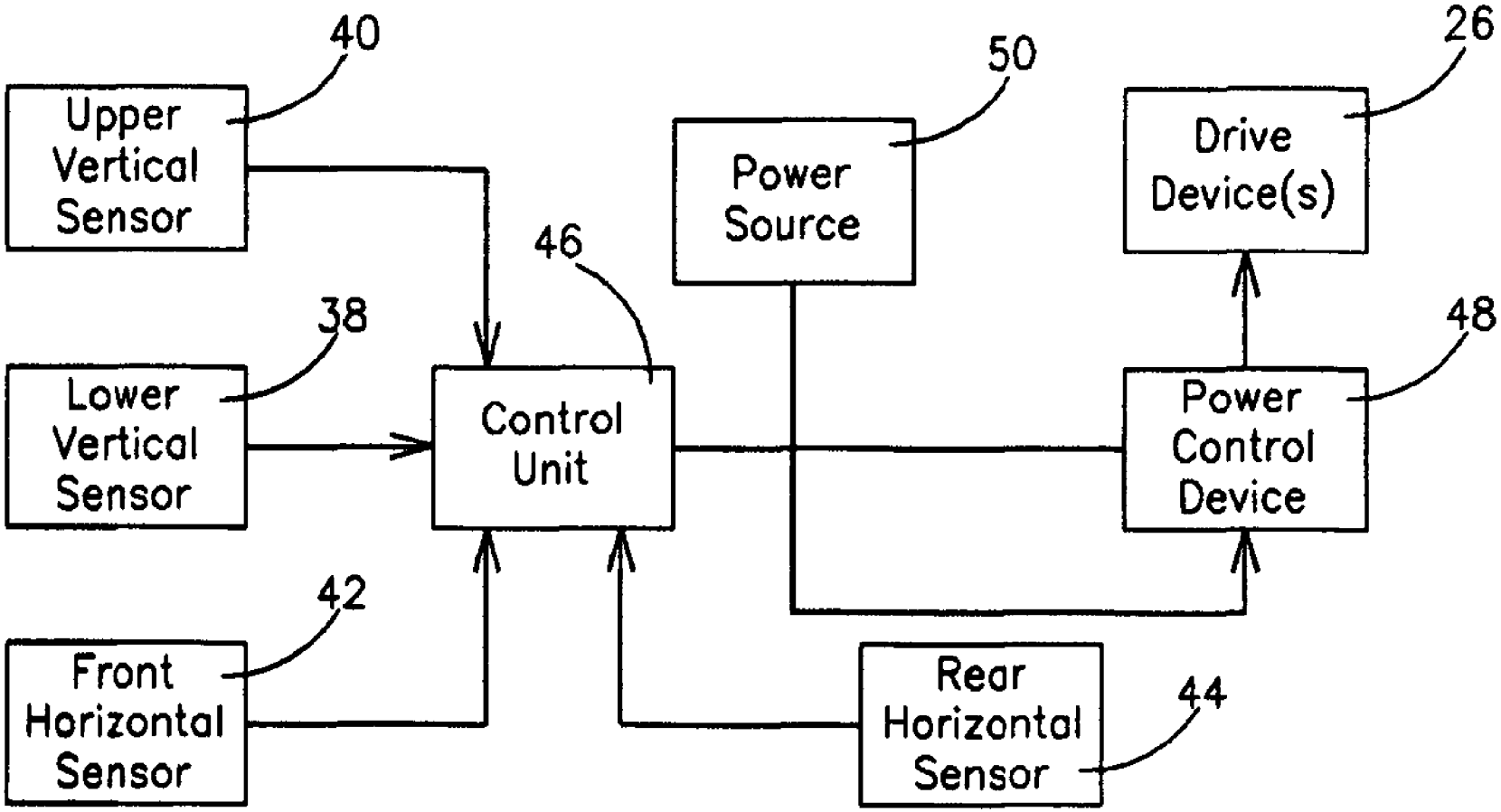
FIG. 9 is a block diagram of a control unit of a variable counterweight system in accordance with the present invention.

With reference to FIG. 9, a lower vertical sensor 38 and an upper vertical sensor 40 determine the position of an attachment or a boom 102 of the skid steer 100. The attachment could be a bucket 104, a fork lift, a grapple or any other type of attachment. A front horizontal sensor 42 and a rear horizontal sensor 44 determine the position of the counterweight 10 relative to a front and rear of the skid steer 100. A control unit 46 receives input from the upper and lower vertical sensors.

If the bucket 104 or the boom 102 are in either an elevated position or a lowered position, then the control unit 46 activates a power control device 48. The power control device 48 could be a hydraulic valve, a relay or any other suitable device. The power control device 48 allows power to flow from a power source 50. The power source 50 could be pressurized hydraulic fluid, electricity or any suitable source of power. Power flows from the power source 50 to the at least one drive device 26, when the power control device 48 is activated. The at least one drive device 26 moves the counterweight 10 to a front of the skid steer 100, if the boom 102 is placed in a lowered position. The at least one drive device 26 is powered, until the front horizontal sensor 42 senses that the counterweight 10 reaches the front of the skid steer 100. The control unit 46 deactivates the power control device 48 to stop the flow of power to the at least one drive device 26. The counterweight 10 located at a front of the skid steer 100 increases pressure on the bucket 104 or other attachment.

The at least one drive device 26 moves the counterweight 10 to a rear of the skid steer 100, if the boom 102 is placed in an elevated position. The at least one drive device 26 is powered, until the rear horizontal sensor 44 senses that the counterweight 10 reaches a rear of the skid steer 100. The control unit 46 deactivates the power control device 48 to stop the flow of power to the at least one drive device 26.

The variable counterweight system 1 should not be limited to use on skid steers, but should include use on any type of earth moving device that elevates an attachment.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A variable counterweight system for a material handling device having an arm that can be raised and lowered, comprising:

a counterweight including a plurality of weight members, wherein said plurality of weight members includes a plurality of pivoting weight members and a plurality of hanging weight members, each one of said plurality of pivoting weight members being pivotally secured to each horizontally adjacent pivoting weight member of said plurality of pivoting weight members, said plurality of hanging weight members being secured to said plurality of pivoting weight members; and a drive arrangement for moving said counterweight from a front of the material handling device to a rear of the material handling device and back, wherein said counterweight can be positioned toward the front of the material handling device when the arm is in a lowered position, and wherein said counterweight can be positioned toward the rear of the material handling device when the arm is in an elevated position.

* * * * *